United States Patent [19]

Kim

[11] Patent Number: 4,956,985

[45] Date of Patent: Sep. 18, 1990

[54] COMBINATION LOCK MECHANISM AND METHOD

[76] Inventor: Sung B. Kim, 4418 Pickett Rd., Fairfax, Va. 22032

[21] Appl. No.: 344,802

[22] Filed: Apr. 28, 1989

[51] Int. Cl.[5] ..... E05B 37/00

[52] U.S. Cl. ..... 70/313; 70/315; 70/214

[58] Field of Search ..... 70/313–315, 70/284–286, 214

[56] References Cited

U.S. PATENT DOCUMENTS

| | | | |
|---|---|---|---|
| 1,871,303 | 8/1932 | Chesick | 70/313 |
| 2,029,080 | 1/1936 | Mills | 70/313 X |
| 2,536,429 | 1/1951 | Dury | 70/313 |
| 2,750,786 | 6/1956 | Sanowskis | 70/313 |
| 3,667,261 | 6/1972 | McGourty | 70/313 X |
| 3,751,951 | 8/1973 | Gridley | 70/313 |
| 4,274,272 | 6/1981 | Wang et al. | 70/313 X |
| 4,627,250 | 12/1986 | Kim | 70/313 X |
| 4,827,743 | 5/1989 | Kim | 70/313 X |

*Primary Examiner*—Robert L. Wolfe
*Assistant Examiner*—Suzanne L. Dino
*Attorney, Agent, or Firm*—Wells & White

[57] ABSTRACT

A combination locking assembly of simplified and robust construction. The combination assembly incorporating easily positionable slide members for setting the combination. The combination assembly also including incremental movement retaining apparatus wherein the locking bar is moved to the unlocked position only when the correct digits are sequentially depressed in the correct order. The combination assembly also allowing multiple use of the same combination digits.

6 Claims, 5 Drawing Sheets

FIG. 16
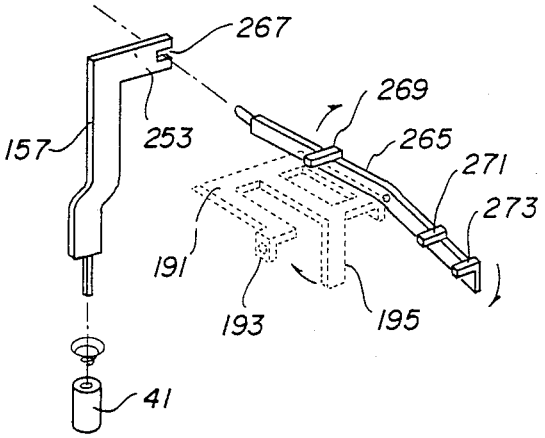
FIG. 17
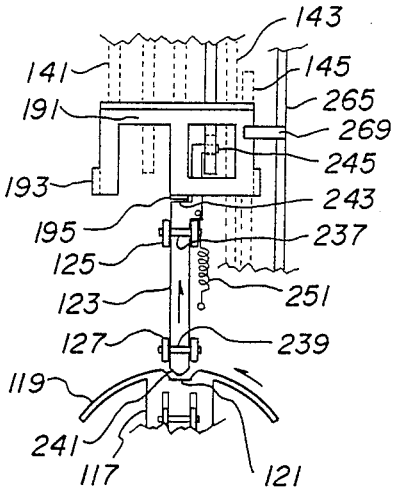
FIG. 18
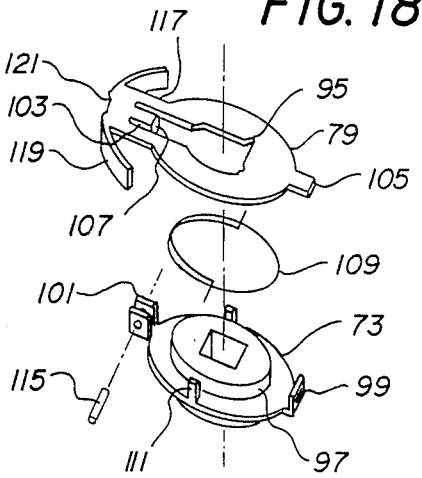
FIG. 19
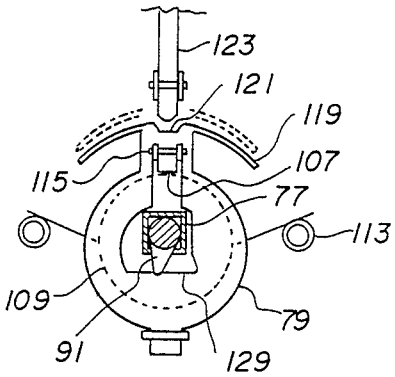
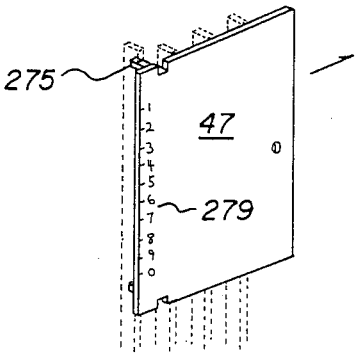
FIG. 20

COMBINATION LOCK MECHANISM AND METHOD

FIELD OF THE INVENTION

The present invention relates to the field of combination locking mechanisms for use with doors. More specifically, the present invention relates to the field of combination locking assemblies having simplified combination changing procedures and associated mechanisms, and greater durability.

BACKGROUND OF THE INVENTION

The present invention is directed at improving upon previously existing combination locking mechanisms. An example of a prior art type combination locking assembly is disclosed in U.S. Pat. No. 4,827,743. This locking assembly included several advantages over previous locking assemblies. The improved combination setting assembly and corresponding structure enabled simplified combination settings for a relatively complex locking assembly. Further, the push buttons of the combination mechanism had substantially the same feel whether the selected number was a correct or incorrect number. The assembly also enabled the use of a single digit for repeated use in a selected combination.

However, this prior art locking assembly, although an improvement over previous attempts in this field, included several disadvantages of design. Firstly, the combination setting sequence was still comparatively difficult owing to the physically small parts comprising the combination setting assembly. Also, the combination assembly was comprised of a large (numerically) stack of combination setting leaves of very small cross section. Even small variances in the manufactured tolerances of the assembly pieces might have resulted in difficulty of operation and resultant shortened durability of the lock.

SUMMARY OF THE INVENTION

In view of the foregoing disadvantages of the prior art combination assemblies, the present invention sets forth several improvements. Firstly, the locking mechanism on the whole includes fewer and substantially simplified moving parts. This feature alone not only shortens assembly and general manufacturing time, but also improves associated durability owing to the decreased number of potential failures caused by excessive complexity. Further, the present invention includes an improved combination setting assembly wherein more rapid and reliable combination setting changes may be performed. Further, the present locking assembly retains the previously improved features of multiple use of a single combination number, as well as substantially equal feel between the correct and incorrectly selected buttons of the combination.

Additional features and advantages of the present invention will become apparent upon the reading of the following description in association with the drawings, and appended claims, which form a part thereof.

BRIEF DESCRIPTION OF THE DRAWINGS

FIG. 16 is an isometric view of the clear bar and associated clear push bar.

FIG. 17 is an elevational view of the locking bar and associated combination bar, advance bar, and clear bar.

FIG. 18 is an isometric view of the locking disc with associated spring and mounting shaft.

FIG. 19 is an elevational view of the locking disc and the locking bar set in an unlocked position.

FIG. 20 is an isometric view of the back cover of the combination lock with the combination bars shown in broken lines.

DETAILED DESCRIPTION OF THE PREFERRED EMBODIMENT

Figure 2:
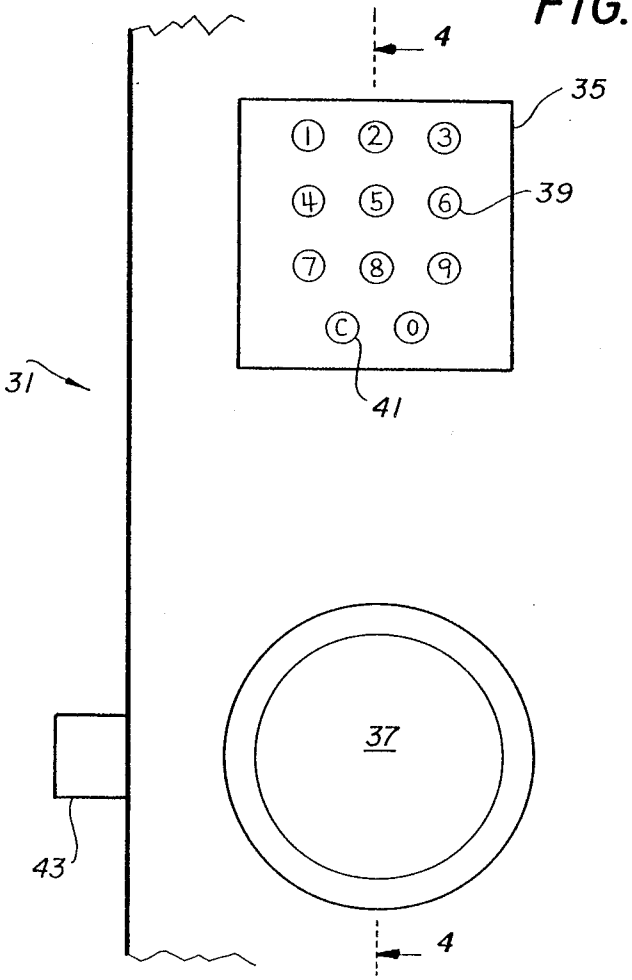
FIG. 2 is an elevational view of the exterior side of the door illustrated in FIG. 1.
Figure 1:
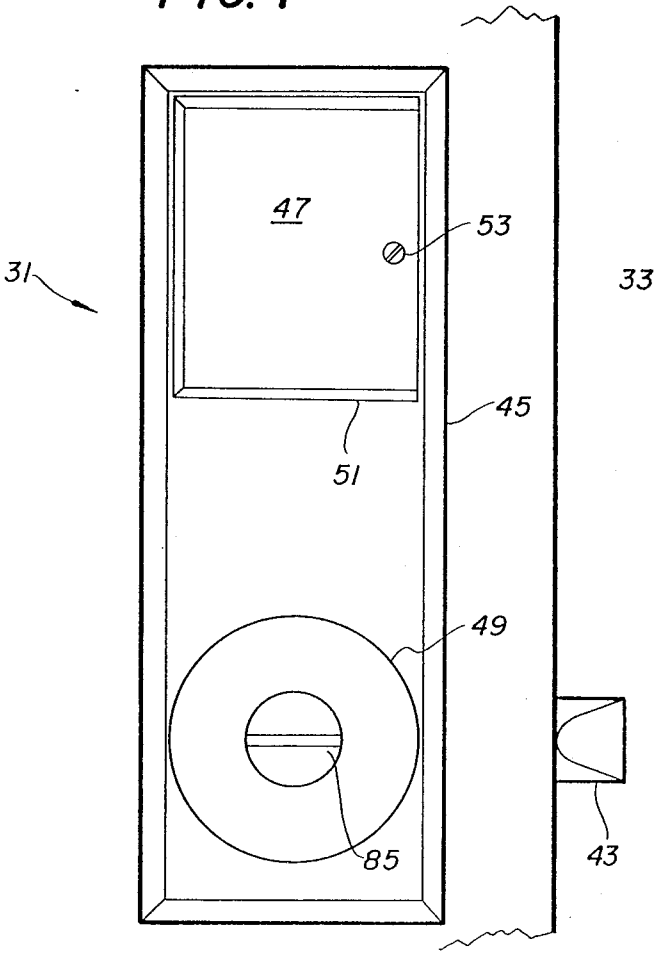
FIG. 1 is an elevational view of the interior side of a door with a combination lock of the present invention in place.

A combination lock in accordance with the present invention is shown in FIGS. 1 and 2 and is designated generally by the reference number 31. As shown therein, the combination lock 31 is installed in a door 33 of conventional design and includes an exterior side (FIG. 2) with an exterior base plate 35 and an exterior door knob 37. A plurality of user-depressible numeric push buttons 39, labeled 0 through 9, and a separate clear button 41, label "c", extend through appropriate clearance openings in the exterior base plate 35.

As explained more fully below, the push buttons 39 are depressible in a user-determined access combination or sequence to effect unlocking of the combination lock 31. The clear button 41 functions to clear or reset the combination lock 31 in the event that an incorrect push button 39 is accidentally depressed. When the push buttons 39 are depressed in proper sequence, the exterior door knob 37 can be rotated to retract a spring bolt (or dead bolt) 43 from a cooperating latch plate (not shown) to allow opening of the door 33.

The interior side of the door 33 (FIG. 1) includes an interior cover 45 with a slidable back cover 47 and an interior door knob 49. The back cover 47 is held in place by channels 51 along which cover 47 can slide sideways (see FIGS. 2, 3, and 4). As shown in FIG. 2, the back cover 47 is kept in its closed position by a threaded fastener 53. When the back cover 47 is slid to its fully open position, the upper portion of the inner combination mechanism will be exposed to the user through the rectangular clearance bore 55. In this way, access is provided to the combination mechanism so that the combination number can be changed in a manner that will be described later.

Figure 3:
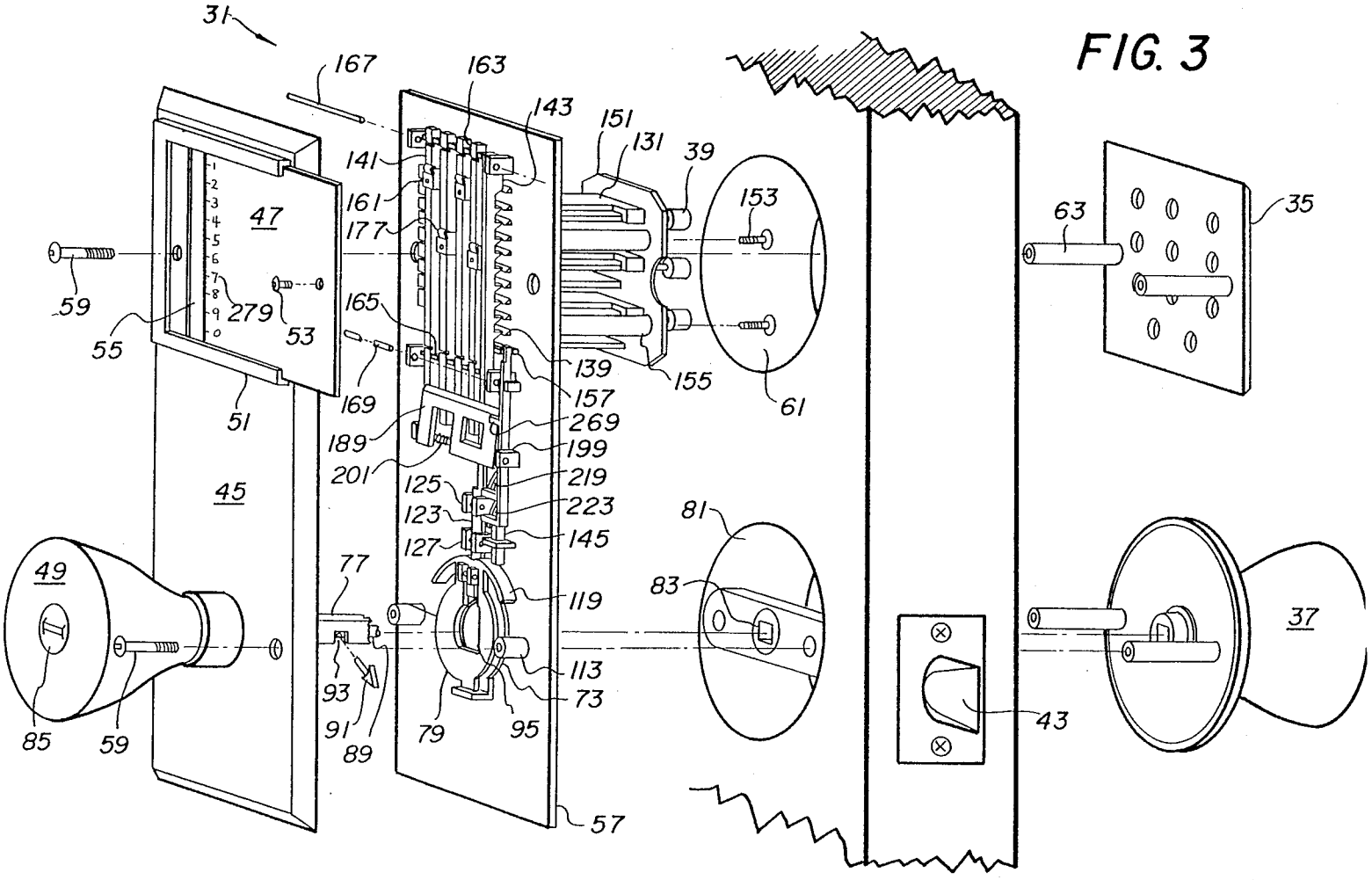
FIG. 3 is exploded isometric view of the combination lock of the present invention.
Figure 4:
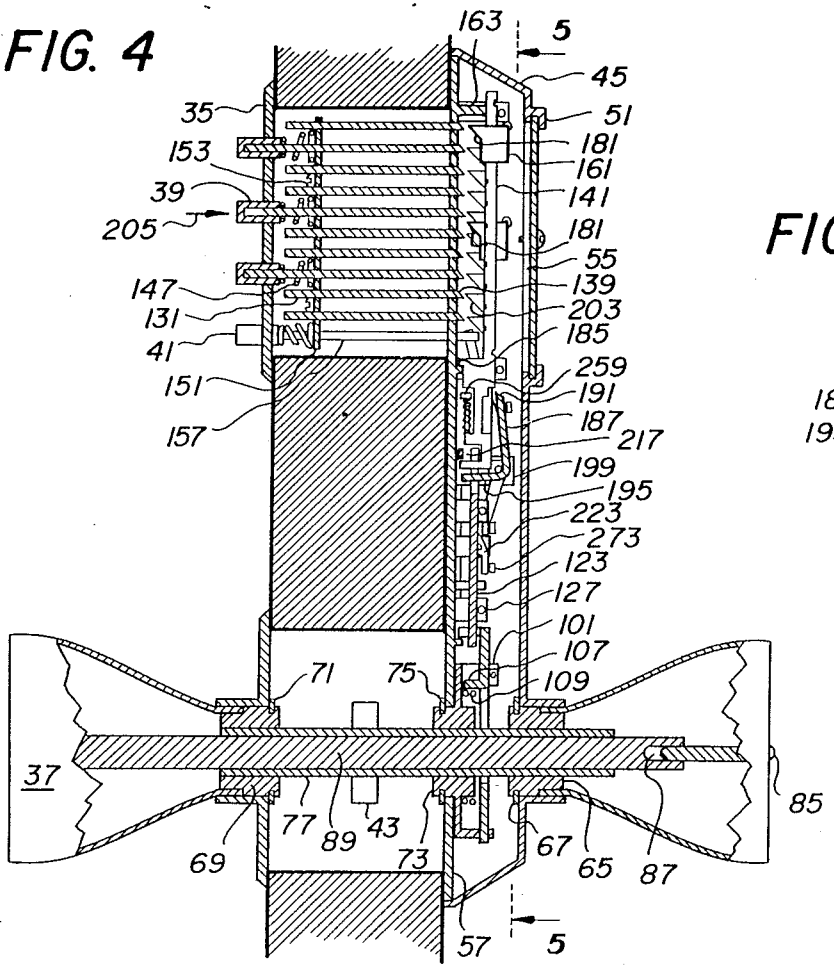
FIG. 4 is a side elevational view, in cross section, of the combination lock assembly taken along line 4—4 of FIG. 2.

As shown in FIGS. 3 and 4, the exterior base plate 35 and the interior cover 45 are mounted on the door 33 in general registration with one another. The base plate 57 is mounted between the interior cover 45 and the interior door surface. The exterior door knob 37 and interior door knob 49 are mounted on a common axis below the combination lock mechanism.

The interior cover 45 and the exterior base plate 35 are connected by threaded fasteners 59 passing through clearance bores (unnumbered) in the base plate 57 and clearance bore 61 in the door. The fasteners engage corresponding threaded studs 63 which extend normally from the interior side of the exterior base plate 35.

As shown in FIG. 4, the interior door knob 49 is secured to an interior knob shaft 65. Shaft 65 is rotatably mounted in the interior cover 45 in an appropriate clearance bore and is retained in place by an E-ring 67. The exterior door knob 37 is secured to an exterior knob shaft 69. Shaft 69 is rotatably mounted in the knob disc (unnumbered) in an appropriate clearance bore and retained in place by an E-ring 71.

Figure 5:
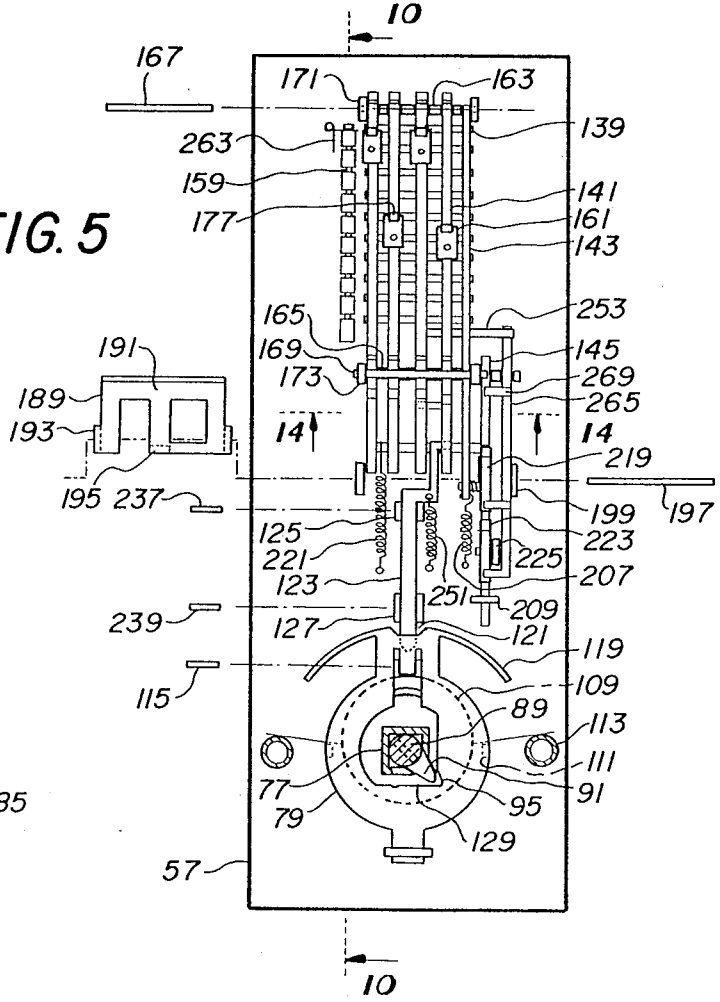
FIG. 5 is a plan view, in cross section, of the combination lock taken along line 5—5 of FIG. 4.

As shown in FIGS. 3, 4, and 5, a mounting shaft 73 is rotatably mounted in the base plate 45 in an appropriate clearance bore and is retained in position by an E-ring 75. A square tube 77 is pressure fit into the central bore of the interior knob shaft 65. The tube 77 extends through the generally circular bore in the center of the locking disc 79, through the center of mounting shaft 73, bore 81 (in the door), through square bore 83 (in a conventional bolt assembly), and finally into the square bore in exterior knob shaft 69 (FIG. 2).

As shown in FIGS. 3 and 4, an unlocking tab 85 is rotatable installed in the center of the interior door knob 49. The inside end of the unlocking tab 85 extends through the oval hole 87 in spindle 89. Spindle 89 extends axially through square tube 77. Pin 91, having a triangular head (see FIG. 3), extends radially through slot 93 in the square tube 77. The pin 91 and slot 93 are positioned so that when the lock is assembled, pin 91 will fit into a notch 95 on the locking disc 79 (see FIG. 5).

As shown in FIGS. 18 and 4, mounting shaft 73 includes a core shaft 97 with a square hole in the center so as to accommodate square tube 77. A tab 99 projects from the extended circumference of the mounting shaft 73. Tab 99 includes a rectangular bore passing therethrough. Shaft 73 also includes a pair of apertured tabs 101 positioned oppositely from tab 99. Apertured tabs 101 extend through parallel slots 103 in the locking disc 79 (FIG. 3).

The bottom end 105 of the locking disc 79 is received into the rectangular bore in the tab 99 of the mounting shaft 73. As shown in FIGS. 18 and 5, a center portion 107 of the locking disc, between parallel slots 103, is bent to reach the mounting shaft 73 and rests against a return spring 109. The return spring 109 is mounted on the core shaft 97 between the mounting shaft 73 and locking disc 79, and is anchored on a pair of studs 111 (FIGS. 18 and 5). The return spring 109 extends further to be anchored again on studs 113 of the base plate 57 so as to urge the mounting shaft 73 to its initial position. (Note, this also urges the locking disc 79 into this same position.)

A pin 115 extends through the apertures in tabs 101 so as to keep the locking disc 79 in place, but at the same time allowing the locking disc 79 to slide up and down against the return spring 109. The locking disc 79 includes a center bore (unnumbered) large enough for the locking disc 79 to move freely up and down. As shown in FIGS. 18 and 5, the opposite side of the locking disc 79 (opposite end 105), includes an extended portion 117. The distal end of the extension 117 includes a pair of circularly curved rectangular tabs 119 bent towards base plate 57. A slot 121 is positioned between the tabs 119 so as to receive the lower end of the locking bar 123. (Note, locking bar 123 moves up and down in its two pairs of guiding tabs 125 and 127, in a manner described later (FIGS. 3 and 17)).

When the door is in a locked condition, the lower end of the locking bar 123 is in the slot 121 between tabs 119. This interengagement of the slot 121 and the locking bar 12 prohibits the locking disc 79 from rotating. If an operator attempted to rotate either the interior or exterior door knob to open the door, square tube 77 would also be caused to rotate which would cause rotation of mounting shaft 73. Rotation of the mounting shaft 73 would, in turn, cause the locking disc 79 to rotate. However, any rotation of the locking disc 79 is prevented owing to the location of locking bar 123 in slot 121 between tabs 119.

If it is necessary to leave the door in an unlocked condition, unlocking tab 85 is turned clockwise from the inside. With unlocking tab 85 in this position, spindle 89 causes pin 91 to also rotate to a corresponding position to the unlocking tab (see FIGS. 3 and 5). As it can be seen in FIGS. 5 and 19, rotation of pin 91 against surface 129 will push the locking disc 79 away from the locking bar 123. When the locking disc 79 is pushed sufficiently to clear the bottom end of the locking bar 123 (FIG. 19), the locking disc 79 will be free to rotate. Hence, the square tube 77 will also be allowed to turn, thus enabling the door to be opened. (The illustrated latch bolt assembly is of conventional design wherein rotation of the square hole 83 will cause bolt 43 to retract.)

Another method of unlocking the door is to enter the correct sequence and combination of numbers into the keypad comprised of buttons 39. When the correct combination is entered, the locking bar 123 is pulled upwardly and out of slot 121. In this manner, the locking disc 79 is allowed to rotate freely, thereby allowing the door to be opened by the retraction of bolt 43.

Figure 12:
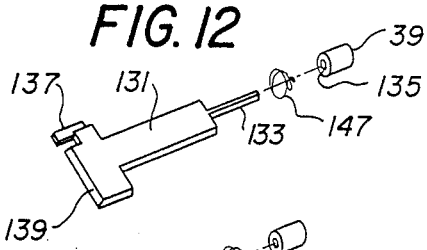
FIG. 12 is an isometric view of a push bar used for the push buttons of the center button column of FIG. 2.

As shown in FIGS. 3 and 4, eleven push buttons extend through the clearance bores provided in exterior base member 35. The push buttons are arranged generally as shown in FIG. 2. The buttons comprising the center column (buttons 2, 5, and 8), along with their associated push bars, have the overall structure shown in FIG. 12. The generally T-shaped push bar 131 includes a stem 133 that is pressure fit in a suitable bore 135 in the push button 39. Opposite to the stem end of the push bar are the first and second force transmitting surfaces 137 and 139. Each of the force transmitting surfaces is a sloped surface, for purposes which will be described later. Generally, however, surface 137 prevents simultaneous depression of a plurality of the push buttons, and surface 139 incrementally urges the combination bars 141, increment bar 143, and advance bar 145, upwardly upon a depression of a push button.

Figure 11:
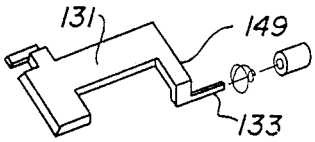
FIG. 11 is an isometric view of a push bar used for the push buttons of the left-most button column of FIG. 2.
Figure 13:
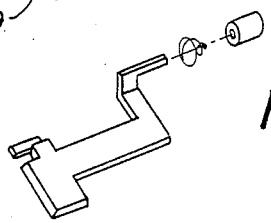
FIG. 13 is an isometric view of a push bar used for the push buttons of the right-most button column of FIG. 2.

A spiral spring 147 is provided on the stem 133 of the push bars so as to urge the push buttons into their fully extended positions. The push bars for the left most column of buttons (buttons 1, 4, and 7) are shown in FIG. 11. The push bar includes a shoulder portion 149, and a stem 133 onto which a push button is pressure fit. The push bar structure of the right most column of buttons (buttons 3, 6, 9, and 0) is shown in FIG. 13. The structures for the respective left, center, and right push buttons when assembled are such that their respective force transmitting surfaces are arranged in an overlying parallel relationship.

The push buttons 39 and push bars 131 ar mounted between the base plate 57 and an intermediate mounting plate 151. Plate 151 is secured by threaded fasteners 153 to receiving studs 155. Studs 155 are integrally formed on the exterior surface of the base plate 57. The force transmitting surfaces 137 and 139 of the push bars pass through appropriately sized clearance bores in base plate 57. The digit push bars 131, clear push bar 157, and the intermediate mounting plate 151, extend through bore 61 in the door toward the exterior side of the door (as shown in FIG. 3).

When a particular push button 39 is depressed, the force transmitting surfaces 137 and 139 advance beyond the base plate 57 toward the interior cover 45 and engage an assembly comprising prohibition bar 159, combination slides 161, and the increment bar 143. As shown in FIGS. 3 and 5, a plurality of combination bars 141 (four in this preferred embodiment) are mounted on the base plate 57. Bars 141 are mounted vertically with their upper portions received in the clearance slots (unnumbered) in upper support wall 163, and their lower portion received in the clearance slot (unnumbered) in the lower support wall 165. Pins 167 and 169 are provided through the clearance bores (unnumbered) in the side walls, 171 and 173 respectively, to keep the combination bars 141 in place (FIGS. 3 and 5).

Figure 6:
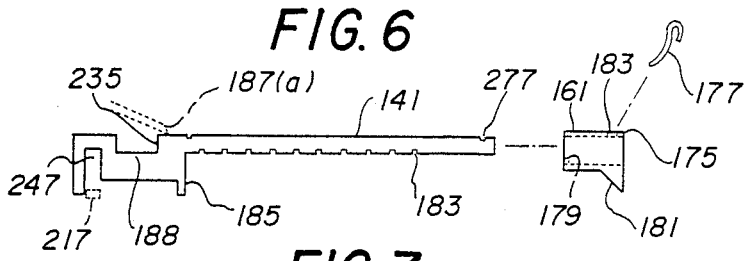
FIG. 6 is an elevational view of the first combination bar with a combination slide ready to be mounted thereon.
Figure 7:
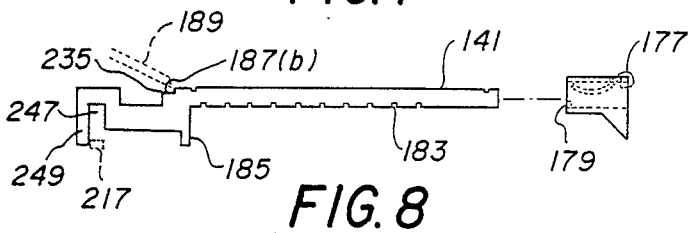
FIG. 7 is an elevational view of the second combination bar with a combination slide ready to be mounted thereon.

As shown in FIGS. 5 and 6, the upper part of the combination bar 141 extends through combination slide 161. The combination slide 161 includes a bridge 175, a curved plate spring 177, a second bridge 179, and a force receiving surface 181. As shown in FIG. 6, the plate spring 177 is inserted into the inner channel (unnumbered) of the combination slide 161 through the clearance bore 183 and pressure fit onto the bridge 175 at its top end. When the combination bar is inserted into the combination slide 161 against the plate spring 177, the second bridge 179 engages one of the slots 183. There are ten slots 183 in this preferred embodiment, each slot corresponding to a the push bar 131. As can be appreciated in FIG. 8, when the combination slide 161 is pushed down manually (in the direction shown by the arrow) against the plate spring 177, the second bridge 179 will be pushed to disengage the slot 183 and the slide 161 is freed to move on the combination bar.

After a combination slide 161 is moved to the desired position, by disengaging slots 183 and sliding number 161, the user can release the combination slide 161 as that the plate spring 177 will urge the second bridge 179 to engage a new slot 183. The position of the combination slide 161 relative to the combination bar 141 is then fixed.

As will be explained below, changing the position of the slide 161 relative to the combination bar 141 results in changing the unlocking combination number.

Figure 14:
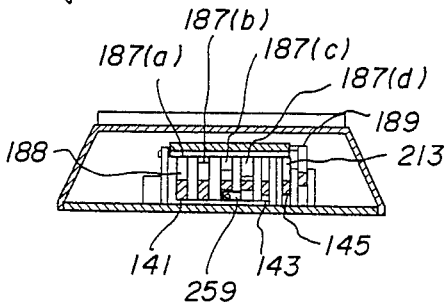
FIG. 14 is a cross sectional view of the combination lock assembly taken along line 14—14 of FIG. 5.

When the lock is reset, the bottom tongue 185 of the combination bar 141 rests against the bottom part of the lower support wall 165 (FIG. 4) to establish an initial position for the combination bars 141. The combination bar also includes platforms 187 and 188 in its lower part. The height of the platforms 187 from the base plate 57 decreases one after another across the successive sequentially actuated combination bars. The height of the platforms 188 from the base plate 57 is the same on all the combination bars. Bridging across platforms 187 is a common panel 189 (FIGS. 3, 4 and 14). As shown in FIG. 16 (in broken line), the common panel 189 includes top bridge 191 and a pair of apertured tabs 193 and leg 195 that is bent toward base plate 57. A pin 197 (FIG. 5) is provided to rotatably mount the common panel 189 on the base panel 57, and extends through the clearance bores in the side support walls 199 and the clearance bore in the apertured tabs 193. As shown in FIG. 3, a torsion spring 201 is mounted on a pin 197 to urge the top bridge 191 toward the base plate 57.

An increment bar 143 is mounted on the base plate 57 in a similar manner (FIGS. 3 and 5) parallel to the combination bars. The increment bar 143 includes a plurality of sloped ramp surfaces 203 (FIG. 15), each corresponding to each push bar 131. Each of the ramp surfaces 203 complements and interacts with the force transmitting surface 139 on each push bar 131. As a result, depression of any push button 39, as shown by an arrow in FIG. 4, will cause the associated push bar 131 to advance towards and increment the increment bar 143. When the push button 39 is released, the push bar 131 retracts so as to allow the increment bar 143 to return to its initial position by a coil spring 207.

Figure 15:
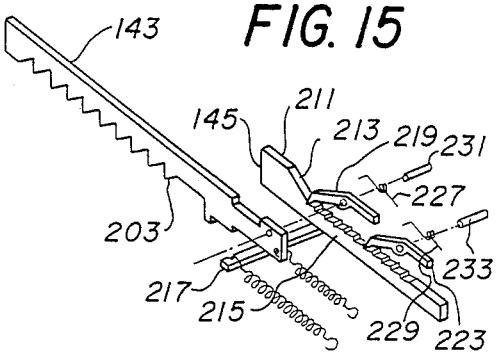
FIG. 15 is an isometric view of the increment bar and associated advance bar.

As best shown in FIG. 5, the advance bar 145 is mounted on the base plate 57 for reciprocating movement. The top of advance bar 145 is received in the clearance slot in the lower support wall 173, and the lower end of the advance bar 145 is received in the clearance bore in a support wall 209. The pin 169 extends over the top of the advance bar 145 to keep it in its place. As shown in FIG. 15, the advance bar 145 includes a top surface 211, a sloped surface 213, a toothed rack 215 and an extension arm 217. The height of the top surface 211 from the base plate 57 is exactly the same as that of the highest platform 187(*a*) on the combination bar 141. The common panel 189, in its initial position, rests on both the top surface 211 and the platform 187(*a*). The height of the bottom of the sloped surface 213 from the base plate 57 is exactly the same as that of the platform 188.

An advance pawl 219 is pivotally carried on the side of the increment bar 143 at its lower end and engages the toothed rack 215 on the advance bar 145. A coiled return spring 221 is anchored in the extension arm 217 to urge the advance bar 145 to its initial position.

In addition, a restraining pawl 223, pivotally mounted on a support wall surface 225 (FIG. 5), also engages the toothed rack 215 on the advance bar 145. Torsion springs 227 and 229 are provided on the mounting pins 231 and 233 to urge the advance pawl 219 and the restraining pawl 223 onto the toothed rack 215. With each depression of the push buttons 39, the engagement of the ramp surface 203 and the force transmitting surface 139 of the push bar 131 will cause the increment bar 143 to move upwardly against the spring 207 (FIGS. 4 and 5). The advance pawl 219, in turn, causes the advance bar 145 to move upwardly. The restraining pawl 223 will maintain the advance bar 145 in its incrementally translated position.

Figure 9:
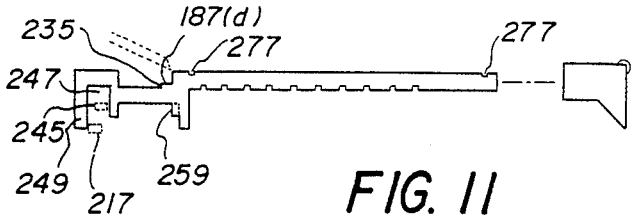
FIG. 9 is an elevational view of the fourth combination bar with a combination slide ready to be mounted thereon.

At the same time, if there is a force receiving surface 181 of the combination slide 161 in the way of push bar 131, (i.e. the top push bar in FIG. 4), the advancing push bar 131 will also engage the force receiving surface 181 at its force transmitting surface 139 and cause the combination slide 161 to translate upwardly. Since the position of the combination slide 161 relative to the combination bar 141 is fixed, the combination bar 141 moves upwardly with the combination slide 161. When the combination bar 141 with the highest platform 187(*a*) has made enough upward movement, the edge 235 clears the bottom edge of the top bridge 191 of the common panel 189 (FIG. 6), and the common panel 189 is allowed to drop down onto the next highest platform 187(*b*). The combination bar 141 with the highest platform 187(*a*) is maintained in the newly translated upward position by the common panel 189. With successive depressions of the push buttons 39, the advance bar 145 with its sloped surface 213, will be allowed to translate incrementally as the common panel 189 rides down the sloped surface 213. When the combination bar 141 with the next highest platform 187(*b*) is moved upwards in the manner described above, the common panel again drops down onto the next highest platform 187(*c*) and the combination bar with the platform 187(*b*) is maintained in its newly incremented upward position by the common panel 189. This process continues until the combination bar 141 with the lowest platform 187(*d*) is moved and maintained in its upward position The locking bar 123, best shown in FIG. 17, is slidably mounted on the base plate 57 as described above and kept in place by the pins 237 and 239. The locking bar 123 includes a sloped surface 241 at its lower end, shoulder surface 243 along the middle portion and a top end tab 245. The top end tab 245 extends through the opening 247 in the lower end of the combination bar 141 and engages the inner wall 249 (FIGS. 9 and 17). As can be appreciated in FIG. 17, when the combination bar 141 with the lowest platform 187(*d*) translates upwardly and is retained in a raised position, the locking bar 123 is pulled upwards against the coiled spring 251 so that its lower end will clear the slot 121 so as to allow the locking disc 79 to rotate. As described above, upon each successful depression of the correct push button 39, the combination bars 141 (and slides 161) translate one after another upwardly. When the last combination bar 141 is moved upwardly, the door is allowed to open.

If there was no combination slide 161 in the way of the advancing push bar 131, the force transmitting surface 139 will actuate only the increment bar 145 to incrementally move the advance bar 145 but no combination bar 141 will also move upwards. When the digits of the combination number are pushed, the top end of the advance bar 145 makes incremental upward movements regardless of whether the right or wrong button was depressed. However, if there was any push button depression without associated combination bar 141 movement, the combination bar 141 with the lowest platform 187(*d*) will remain in its initial position and the door remains locked.

Since the combination slides 161 can be moved to any position to engage the corresponding push bar 131, the same number can be used repeatedly in this lock.

Also, since the common panel 189 will only be allowed to drop to the next highest platform only if, (1) all of the sequentially previous combination bars 141 with higher platforms were moved upwards and, (2) the common panel was at the right place along the sloped surface 213, the combination digits must be pushed in the correct sequence.

The second requirement of the above statement can be better understood by the extreme example of a combination number 2, 2, 2, 2. In this case, all of the combination slides 161 are fixed in front of the second push bar 131. When the user pushes the push button labelled 2, the push bar will engage all of the combination slides 161 simultaneously, and all of the combination bars 141 will be pushed upwards. Since all of the combination bars are in their upward position, the common panel 189 would likely drop down all the way to the lowest platform 188. However, one end of the common panel also rides on the sloped surface 213 as shown in FIGS. 14 and 77. The advance bar 145 has made only one incremental move and the height of the common panel on the sloped surface 213 is only equal to the second highest platform 187(*b*) on the combination bar 141. Therefore, the common panel can drop down only to the height of the second highest platform (b) locking only the combination bar with the highest platform 187(*a*) in its newly upward position. The rest of the combination bars will return to their initial position when the button is released, preventing the user from unlocking the door with one push button actuation.

Even though the system described above is very simple and efficient, it contains two inherent problems. The first problem is that one can unlock the door by pushing each of the push buttons 39 one after another, each time turning the door knob while holding the push button down. In this process, one of the push buttons 39 will actuate the combination bar 141 with the lowest platform 187(*d*) which will pull the locking bar 123 upwards. By holding down the push button, the locking bar 123 stays clear of the slot 121 and the door can be opened. The second problem is that the door can be opened by repeatedly pushing all the push buttons simultaneously until the door opens. When all the push buttons are pushed together, at least one of them will actuate one combination bar.

Figure 8:
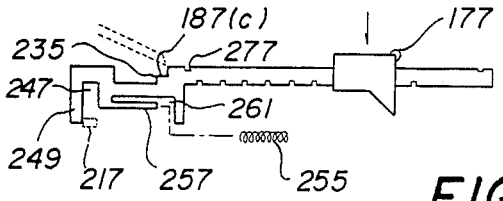
FIG. 8 is an elevational view of the third combination bar with a combination slide mounted thereon.

To resolve the first problem, the combination bars 141 with the third highest platform 187(*c*) and the lowest platform 187(*d*) are modified as below. As shown in FIGS. 8 and 4, the combination bar with the platform 187(*c*) includes a compression spring 255 mounted on a projecting pin 257. The combination bar with the platform 187(*d*) includes an extension arm 259 that extends horizontally through the opening 261 in the combination bar with the platform 187(*c*) and engages the spring 255 (FIG. 4). Also, the 10 position of the combination slide 161 on the combination bar with the platform 187(*d*) relative to the force transmitting surface 139 is different from the others.

FIGS. 4 and 5 show the position of the combination slides for the opening combination number 1, 5, 1, 5. The combination slide 161 on the combination bar with the platform 187(*d*) is lower than the position to engage the force transmitting surface 139. Depressing the number 5 button can actuate only the combination bar with the platform 187(*b*) but not the one with the lowest platform 187(*d*). The combination slide 161 on the combination bar with the platform 187(*d*) will come into the position to engage the force transmitting surface 139 only after the combination bar with the platform 187(*c*) is moved and maintained in an upward position. In that event, the spring 255 moves upwardly and moves the combination bar with the lowest platform 187(*d*) into the position to engage its corresponding push bar. The top end 245 of the locking bar 123 will also come to engage the inner wall 249 at that time so that further upward movement of the combination bar will start moving the locking bar 123.

Figure 10:
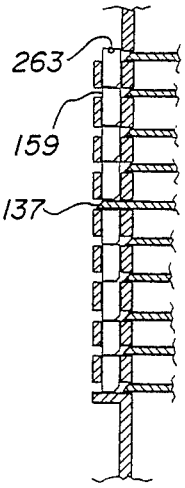
FIG. 10 is a side elevational view, in cross section, of the prohibition assembly taken along line 10—10 of FIG. 5.

To resolve the second problem, a plurality of prohibition bars 159 are used. As shown in FIG. 10, the prohibition bars 159 are stacked vertically one atop another in the channel (unnumbered) integrally made on the base plate 57. When a push button 39 is pushed, the force transmitting surface 137 pushes the corresponding prohibition bar 159. It is obvious in FIG. 10 that none of the push bars above or below the one already depressed can advance toward the back cover 45. A torsion spring 263 (FIG. 5) is provided to return the prohibition bars 159 when the push bar retracts.

In the event the user made a mistake and wishes to start all over again, the clear button 41 can be used to reset the lock. The clear bar 265 is mounted for pivotal movement on the pin 197 and guided by a slot (unnumbered) in the lower support wall 165 (FIG. 5). The clear push bar 157 includes a clearance opening 267 for engagement with the clear bar 265. The clear button 41 is pressure fit on the opposite end of the clear push bar 157 from the clearance opening 267. A spiral spring (unnumbered) is provided against the intermediate mounting plate 51 to urge the clear push bar 157 and the clear bar 265 to their initial position.

As shown in FIG. 16, the clear bar 265 includes three parallel clear arms 269, 271 and 273. These arms are positioned so as to be over the common panel 189, advance pawl 219, and restraining pawl 223 respectively. When the clear button 41 is depressed, the clear bar 265, as shown in FIGS. 5 and 16, pivots and the clear arms 271 and 273 push the pawls 219 and 223 to disengage from the toothed rack 215. The advance bar 145 will be forced back to its initial position by urge of the spring 221. As the advance bar returns, its extension arm 217 engages the inner walls 249 on each of the combination bars 141 (FIGS. 4) and starts urging the bars 141 to their initial position. At the same time, the top bridge 191 of the common panel 189, which was restraining the combination bars in their upward positions, is lifted by the sloped surface 213 of the advance bar 145 as the advance bar returns. As a result, the combination bars lose their restraint and return to their initial positions by the extension arm 217.

The lock will also reset every time the door knob is turned. As shown in FIG. 17, when the user turns the exterior door knob, the locking disc 79 will rotate with the top of the rectangular tab 119 rotating against the sloped surface 241. The locking bar 123 will then be pushed upwards. The shoulder surface 243 pushes the leg 195 of the common panel 189. The common panel 189, in turn, lifts up the clear arm 269, pivoting the entire clear bar 265 in the direction shown by arrows in FIG. 16. The result is the same as pushing the clear button 41 and the lock resets.

The combination number can be changed by sliding the back cover 47 and moving the combination slides to the desired positions. The back cover 47 includes a pair of tabs 275 which slide in the direction shown by the arrow in FIG. 20 as the back cover slides. When the combination bars 141 are in their initial position, the tabs 275 are blocked by the combination bar 141 and the back cover can not be slid open. When a combination bar 141 is moved up by correct push button actuation as shown by the first combination bar in FIG. 20, the slots 277 will move into a position to allow the tabs 275 to pass through. In the same manner, the back cover 47 can be slid open only after the correct combination has been entered and all of the combination bars 141 have been moved upwardly. When the back cover 47 is opened the combination slides are presented to the user. By using index numbers 279 on the back cover, the user can move the combination slides position which will result to the desired in a new combination unlocking number as described above.

While the invention is described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A combination locking apparatus, comprising:

combination slide means for designating a selected combination digit;

combination bar means associated with each of said combination slide means for slidably mounting said combination slide means thereon at selected intervals;

push button means for selectively actuating a combination digit;

push bar means associated with each of said push button means for transmitting the actuating motion of said push button means to said combination slide means, and successively incrementing each of said combination slide means and combination bar means to a translated first position;

common panel means for engaging and maintaining each of said combination bar means in said first position as successively correct combination digits are selected, said common panel means engaging successively deeper notches in each of said combination bar means to maintain said bars in said first position.

2. A combination locking apparatus as in claim 1, further comprising:

locking bar means for locking a latch assembly and being movable between a first locket position and a second unlocked position, said locking bar means being biased to remain in said first locked position, and being moved to said second unlocked position by the translated movement of said combination bar actuated by the actuation of the final successively correct digit in a correct combination sequence.

3. A combination locking apparatus as in claim 1, wherein:

the combination bar associated with the last correct digit in a correct combination sequence can only be actuated if the preceding digit has already been correctly selected.

4. A combination locking apparatus as in claim 1, further comprising:

prohibition bar means for inhibiting the simultaneous depression of more than a single push button.

5. A combination locking apparatus as in claim 4, wherein:

said prohibition bar means comprises a row of bar segments which accept the insertion of a push bar member between the bar segments when the push bar is actuated, the insertion of a single push bar between the bar segments displacing the row of bar segments thereby misaligning and preventing additional insertions of push bars in between the displaced row of bar segments.

6. A method of changing the combination in a combination locking apparatus, comprising:

a plurality of combination slide means for designating a selected combination digit;

a plurality of combination bar means associated with each of said combination slide means for slidably mounting said combination slide means at selected intervals therealong; and, a plurality of push bar members for actuating each of said combination slide means aligned with said slide means; wherein, changing the selected combination digit is accomplished by sliding said combination slide means along said combination bar means to a different selected interval, and thereby aligning said combination slide means with a different one of said plurality of push bar members.

* * * * *